US010670240B2

(12) United States Patent
Shih

(10) Patent No.: US 10,670,240 B2
(45) Date of Patent: Jun. 2, 2020

(54) MODULAR, EASY TO INSTALL AND REMOVE, TRACK LIGHT

(71) Applicant: Dongguan Zhao He Lighting Co., Ltd., Dongguan, Guangdong Province (CN)

(72) Inventor: Ming Feng Shih, Dongguan (CN)

(73) Assignee: Dongguan Zhao He Lighting Co., Ltd., Dongguan (CN)

( * ) Notice: Subject to any disclaimer, the term of this patent is extended or adjusted under 35 U.S.C. 154(b) by 117 days.

(21) Appl. No.: 16/171,278

(22) Filed: Oct. 25, 2018

(65) Prior Publication Data

US 2020/0056767 A1 Feb. 20, 2020

(51) Int. Cl.
*F21V 19/00* (2006.01)
*F21V 19/02* (2006.01)
(Continued)

(52) U.S. Cl.
CPC ..... *F21V 19/0035* (2013.01); *F21S 8/036* (2013.01); *F21V 17/164* (2013.01); *F21V 19/02* (2013.01);
(Continued)

(58) Field of Classification Search
CPC ..... F21V 17/104; F21V 17/10; F21V 17/16; F21V 17/164; F21V 19/0025; F21V 19/0035; F21V 19/004; F21V 19/0045; F21V 19/02; F21V 21/14; F21V 21/15; F21V 21/26; F21V 21/28; F21V 21/30; F21V 21/34; F21V 21/35; F21V 23/001; F21V 23/003; F21V 23/06; H01R 4/48; H01R 4/4809; H01R 4/4818;
(Continued)

(56) References Cited

U.S. PATENT DOCUMENTS 5,128,847 A * 7/1992 Lin ..... F21V 23/02 362/147
6,152,583 A * 11/2000 Langner ..... F21V 21/30 362/427
(Continued)

FOREIGN PATENT DOCUMENTS

CA 2859584 A1 * 2/2015 ..... F21V 19/007
WO WO-2016150564 A2 * 9/2016 ..... F21V 21/34

*Primary Examiner* — Bryon T Gyllstrom
*Assistant Examiner* — Colin J Cattanach
(74) *Attorney, Agent, or Firm* — Lightbulb IP, LLC

(57) ABSTRACT

A modular track light includes an electrical box and an adaptor that links the modular track light to a track. This adaptor connects to the electrical box through one or more rotating components. The electrical box has a groove with a power supply plate therein. The power supply plate is slidably removable from a power consumption plate which is attached to a fixture through one or more additional rotating components. When the power consumption plate is fastened to the power supply plate, an electrode clip on the power consumption plate engages an electrode contact point on the power supply plate, creating an electrical connection between the electrical box and the fixture. When these plates are separated, the electrode clip disengages the electrode contact point, disconnecting the electrical box and the fixture. The modular track light is easy to replace and can fulfill the demands of different applications.

10 Claims, 9 Drawing Sheets

(51) Int. Cl.

| | |
|---|---|
| ***F21V 23/00*** | (2015.01) |
| ***F21V 17/16*** | (2006.01) |
| ***F21S 8/00*** | (2006.01) |
| ***F21Y 115/10*** | (2016.01) |
| ***F21V 29/70*** | (2015.01) |
| ***F21V 21/15*** | (2006.01) |
| ***F21V 17/00*** | (2006.01) |
| ***F21V 21/14*** | (2006.01) |
| ***F21V 21/34*** | (2006.01) |
| ***F21S 8/06*** | (2006.01) |
| ***F21V 21/26*** | (2006.01) |
| ***F21V 21/30*** | (2006.01) |
| ***H01R 25/14*** | (2006.01) |
| ***F21S 8/04*** | (2006.01) |
| ***F21V 21/35*** | (2006.01) |
| ***F21V 21/28*** | (2006.01) |
| ***F21V 23/06*** | (2006.01) |
| *F21V 17/10* | (2006.01) |

(52) U.S. Cl.

CPC ..... *F21V 23/001* (2013.01); *F21V 23/003* (2013.01); *F21S 8/038* (2013.01); *F21S 8/043* (2013.01); *F21S 8/066* (2013.01); *F21V 17/10* (2013.01); *F21V 17/104* (2013.01); *F21V 17/16* (2013.01); *F21V 19/004* (2013.01); *F21V 19/0025* (2013.01); *F21V 19/0045* (2013.01); *F21V 21/14* (2013.01); *F21V 21/15* (2013.01); *F21V 21/26* (2013.01); *F21V 21/28* (2013.01); *F21V 21/30* (2013.01); *F21V 21/34* (2013.01); *F21V 21/35* (2013.01); *F21V 23/06* (2013.01); *F21V 29/70* (2015.01); *F21Y 2115/10* (2016.08); *H01R 25/14* (2013.01)

(58) Field of Classification Search

CPC .... H01R 4/4827; H01R 4/4836; H01R 25/14; F21S 8/036; F21S 8/038; F21S 8/043; F21S 8/066

See application file for complete search history.

(56) References Cited

U.S. PATENT DOCUMENTS

| | | | | |
|---|---|---|---|---|
| 7,648,263 | B2 * | 1/2010 | Bartlett | F21V 21/35 362/147 |
| 2005/0078482 | A1 * | 4/2005 | Bartlett | F21V 19/02 362/285 |
| 2005/0151040 | A1 * | 7/2005 | Hsu | B62J 11/00 248/214 |
| 2006/0209531 | A1 * | 9/2006 | Tiesler | B60R 16/03 362/95 |
| 2009/0135602 | A1 * | 5/2009 | Liu | F21S 2/005 362/275 |
| 2011/0103065 | A1 * | 5/2011 | Cowan | F21V 17/164 362/296.01 |
| 2017/0254521 | A1 * | 9/2017 | Tanimura | F21V 13/14 |
| 2017/0261163 | A1 * | 9/2017 | Brennenstuhl | F21S 9/02 |
| 2018/0119925 | A1 * | 5/2018 | Yamae | G02B 7/02 |
| 2018/0306390 | A1 * | 10/2018 | Chami | F21S 2/005 |

* cited by examiner

MODULAR, EASY TO INSTALL AND REMOVE, TRACK LIGHT

BACKGROUND OF THE INVENTION

1. Cross-Reference to Related Application

This application claims priority to Chinese Patent Application No. 201821333734.1, filed Aug. 18, 2018.

2. Field of the Invention

The invention relates to track lights and in particular a kind of a modular, easy to install and remove, track light.

3. Related Art

A track light is a kind of light that is installed on a track, and can adjust its lighting area and degree. A track light can be used as a spot light, such as in a shopping mall, clothing store, jewelry store, car dealership, hotel, museum, show window, or counter.

There can be different demands for the luminance, focal distance, lighting shape and color for a track light based on the application. Currently, manufacturers produce a multitude of distinct independent models of track light in order to fulfill these various demands.

From the discussion that follows, it will become apparent that the present invention addresses the deficiencies associated with the prior art while providing numerous additional advantages and benefits not contemplated or possible with prior art constructions.

SUMMARY OF THE INVENTION

A modular track light is disclosed herein. The modular track light solves the drawbacks of current technology, providing a modular, easy to install and remove track light which is suitable for different applications. Though a variety of track lights exist, their assembly is complex, replacement is not easy, and productivity is low for current track lights. Accordingly, the market urgently needs a modular, easy to install and remove track light, which can fulfill the demands of a variety of different applications.

In order to solve above technical issues, the modular track light provides a track light that is easy to install and remove. The modular track light includes an adaptor which links the track and its fixture. This adaptor links the electrical box through one or more rotating components. There is a wire inside the electrical box. The rotating components, the adaptor, and this wire connect the electrical box to power. There is a groove mounted in the electrical box. There is a power supply plate inside the groove. The power supply plate links the power consumption plate. The power consumption plate links the fixture through the first rotating components. The power consumption plate can slide relative to the power supply plate. The power consumption plate can be fastened or removed from the power supply plate by a snap joint which is mounted on the groove. When the power consumption plate is fastened on the power supply plate, an electrode clip on the power consumption plate connects with electrode contact point on the power supply plate, which creates and electrical connection between the electrical box and the fixture. When the power consumption plate is removed from the power supply plate, the electrode clip on the power consumption plate separates the electrode contact point on the power supply plate, which disconnects the electrical box and the fixture.

Further explanation for the above technical solution will now be disclosed. In above technical solution, the rotating components include an axle. This axle links the adaptor. The axle also extends inside the electrical box. When the axle rotates, it will cause the electrical box to rotate.

The first rotating components include an axle. One side of the axle is fastened on the power consumption plate through the nut, and the other side of the axle is linked with the fixture though the lock plate. The axle extends into the pillar on the consumption plate. When the axle swings, it will cause the fixture to swing relative to the electrical box.

The electrical box may be a box with a groove or other indentation formed therein. There is a dimmer at the electrical box. The dimmer connects the power supply plate and the wire which connects to outside power. A frame covers or may be formed by an edge of the electrical box. A first panel and second panel are installed on the frame. The first panel and second panel match openings of the frame.

There are bars on the two sides of the power supply plate which match the grooves on the two sides of the power consumption plate. These structures allow the power consumption plate to slide relative to the power supply plate. There is a snap joint installation hole on the grooves. When the snap joint vertical moves into the installation hole, the power consumption plate is fastened with the power supply plate. When the snap joint vertical moves out the installation hole, the power consumption plate is separated from the power supply plate.

In the above technical solution, the fixture may have an adjustable beam angle degree from 10° to 45°.

In the above technical solution, the fixture may have a certain beam angle degree (12°, 24°, or) 36°.

In the above technical solution, the fixture may have a polarized lighting wall washer fixture.

In the above technical solution, the fixture may have an inserting plate cutting light lens fixture.

One advantage of the modular track light is that it may provide four different fixture versions (the adjustable beam angle degree from 10° to 45°, the certain beam angle degree (12°, 24°, or 36°), the polarized lighting wall washer fixture, and the polarized lighting wall washer fixture), with each fixture version being easy to be replaced. Therefore, the modular track light can fulfill different demands.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The following provides further explanation of this new invention.

These explanation for this new patent is only to disclose this new invention, rather than a limitation thereof. The words "center," "vertical," "crosswise," "length," "width," "thickness," "up," "down," "front," "back," "left," "right," "horizontal," "upon," "bottom," "inside," "outside," "clockwise," and "anticlockwise" are merely for the description of the invention, and do not mean the components need the certain direction and implementation. Therefore, these words cannot be limiting for the invention. Moreover, the words "first" and "second" are only for description purposes, and are not meant to indicate any relative importance or technical characteristics. So first and second characteristic can include one or more characteristics. Except where there is a clear limitation, the word "connection" can mean the fixed connection, replaceable connection, mechanical connection, electrical connection, direct connection, or indirect connection. The words "installation," "link," and "fasten" are also the same situation as the word "connection." Except where there is a clear limitation, the first characteristic being on the bottom or upon the second characteristic can mean the first characteristic contacts the second characteristic directly or indirectly. The first characteristic being higher or up the second characteristic merely means the horizontal height of first characteristic is higher than the second characteristic. The first characteristic being lower or down from the second characteristic merely means the horizontal height of first characteristic is under the second characteristic.

First Embodiment

Figure 1:
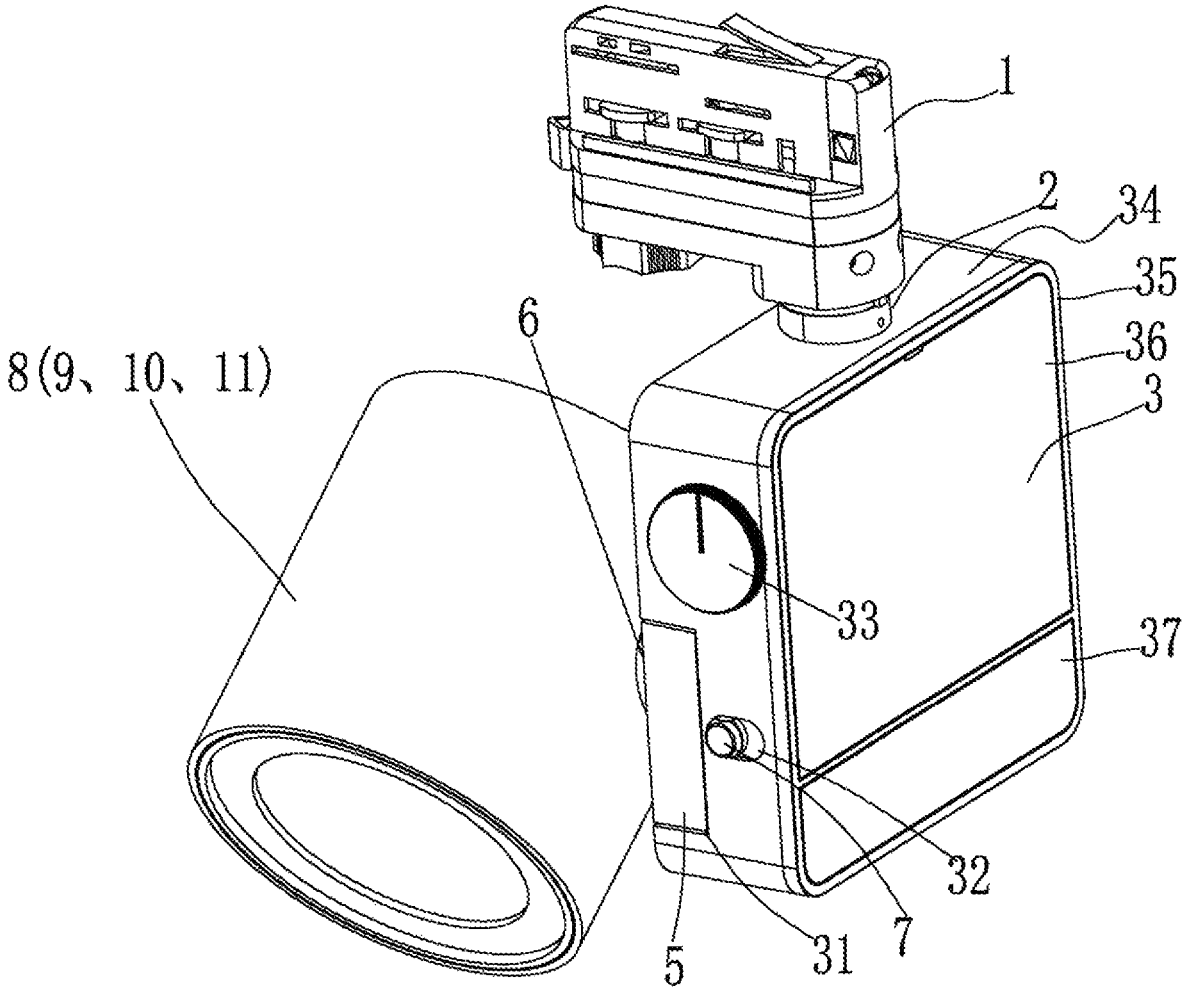
FIG. 1 is a perspective view of an exemplary modular track light.
Figure 2:
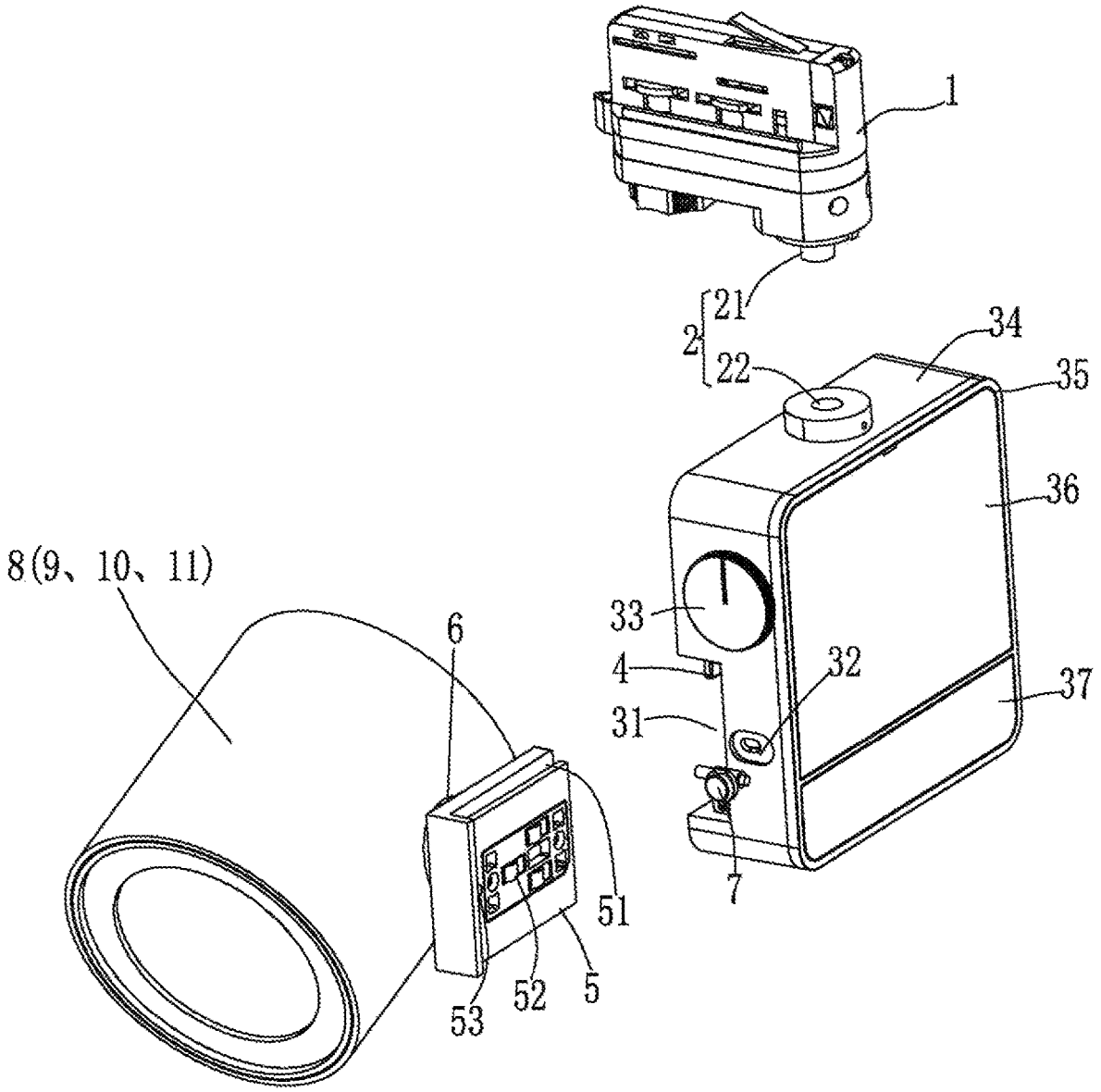
FIG. 2 is an exploded view of an exemplary modular track light.
Figure 3:
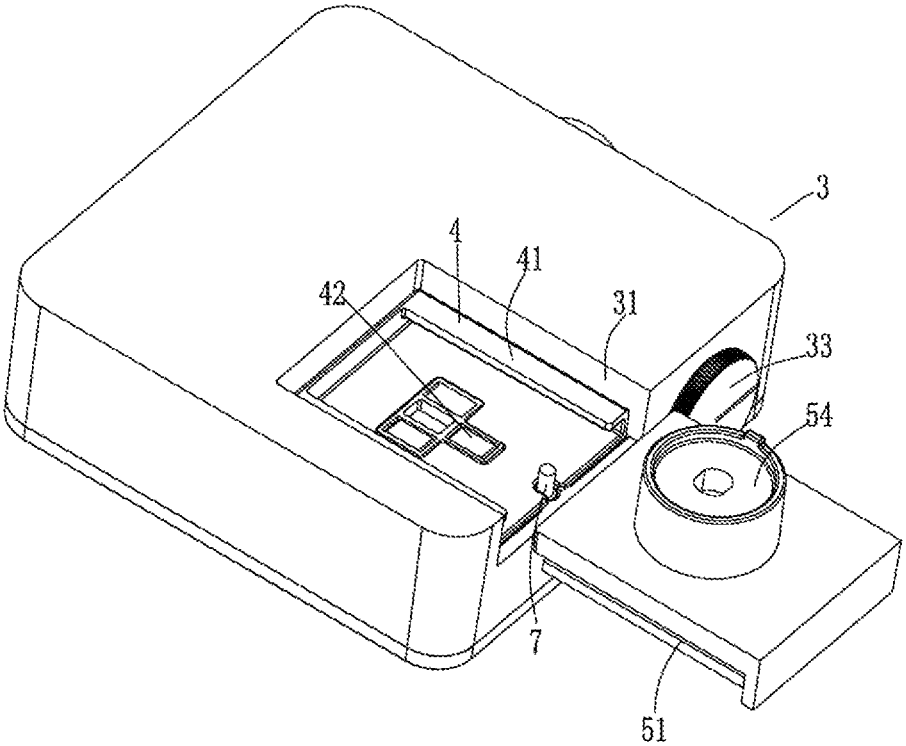
FIG. 3 is a perspective view of an exemplary power supply plate and power consumption plate.
Figure 4:
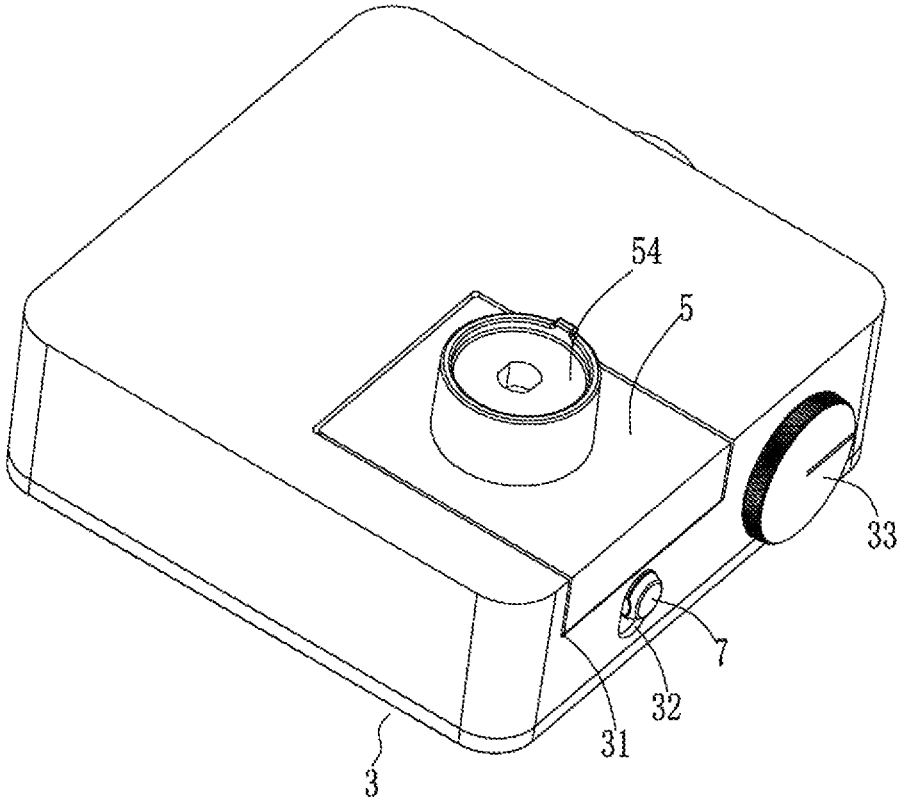
FIG. 4 is a perspective view of an exemplary power supply plate and power consumption plate.
Figure 5:
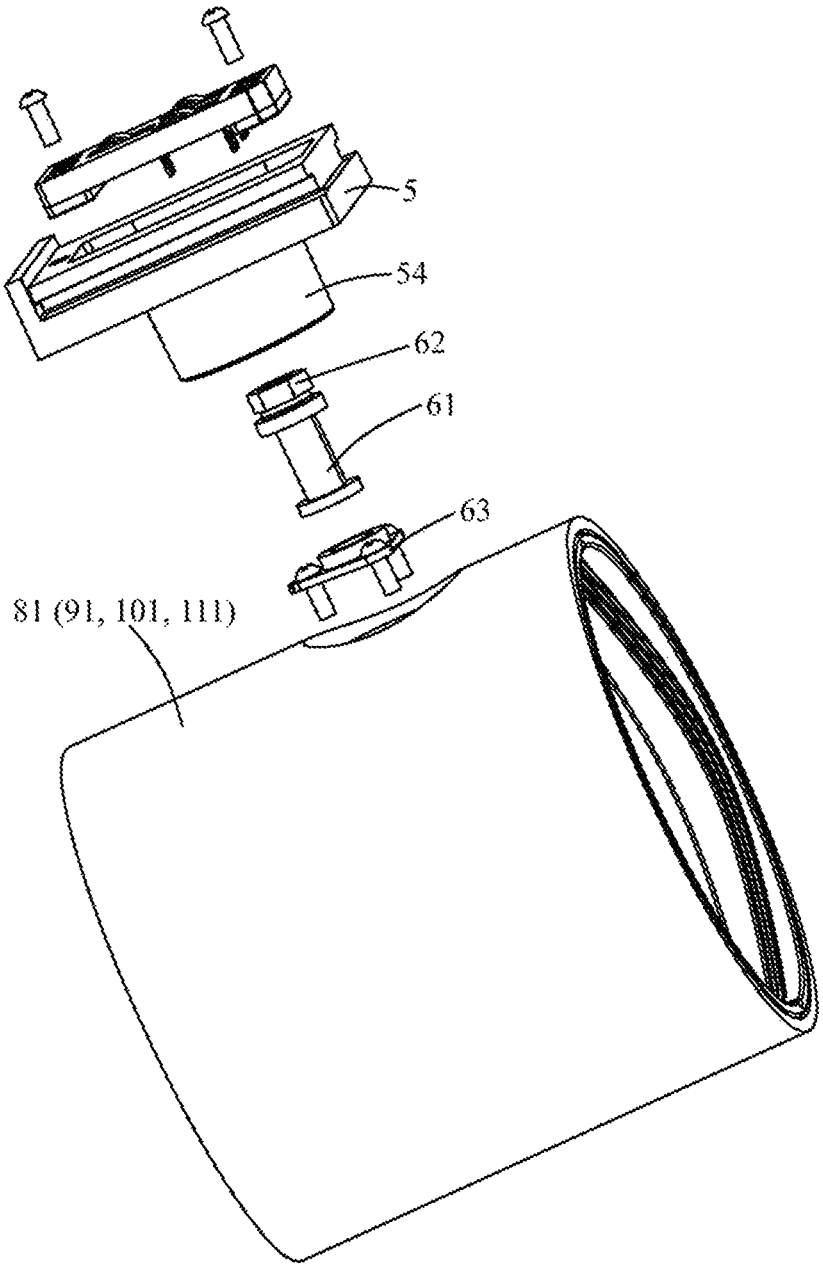
FIG. 5 is an exploded view of an exemplary power consumption plate, first rotating components, and fixture.
Figure 6:
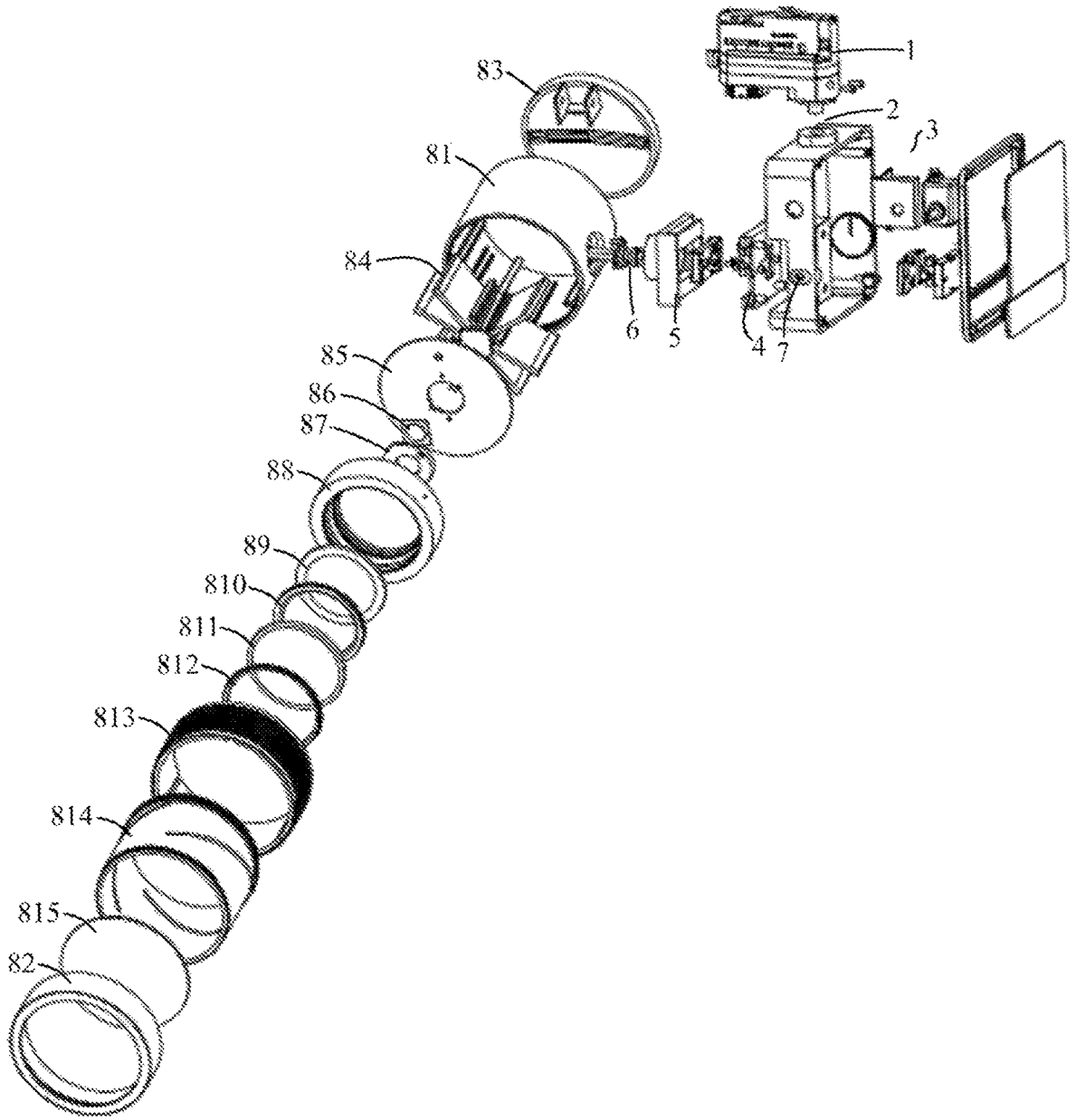
FIG. 6 is an exploded view of a first embodiment of an exemplary modular track light.
Figure 7:
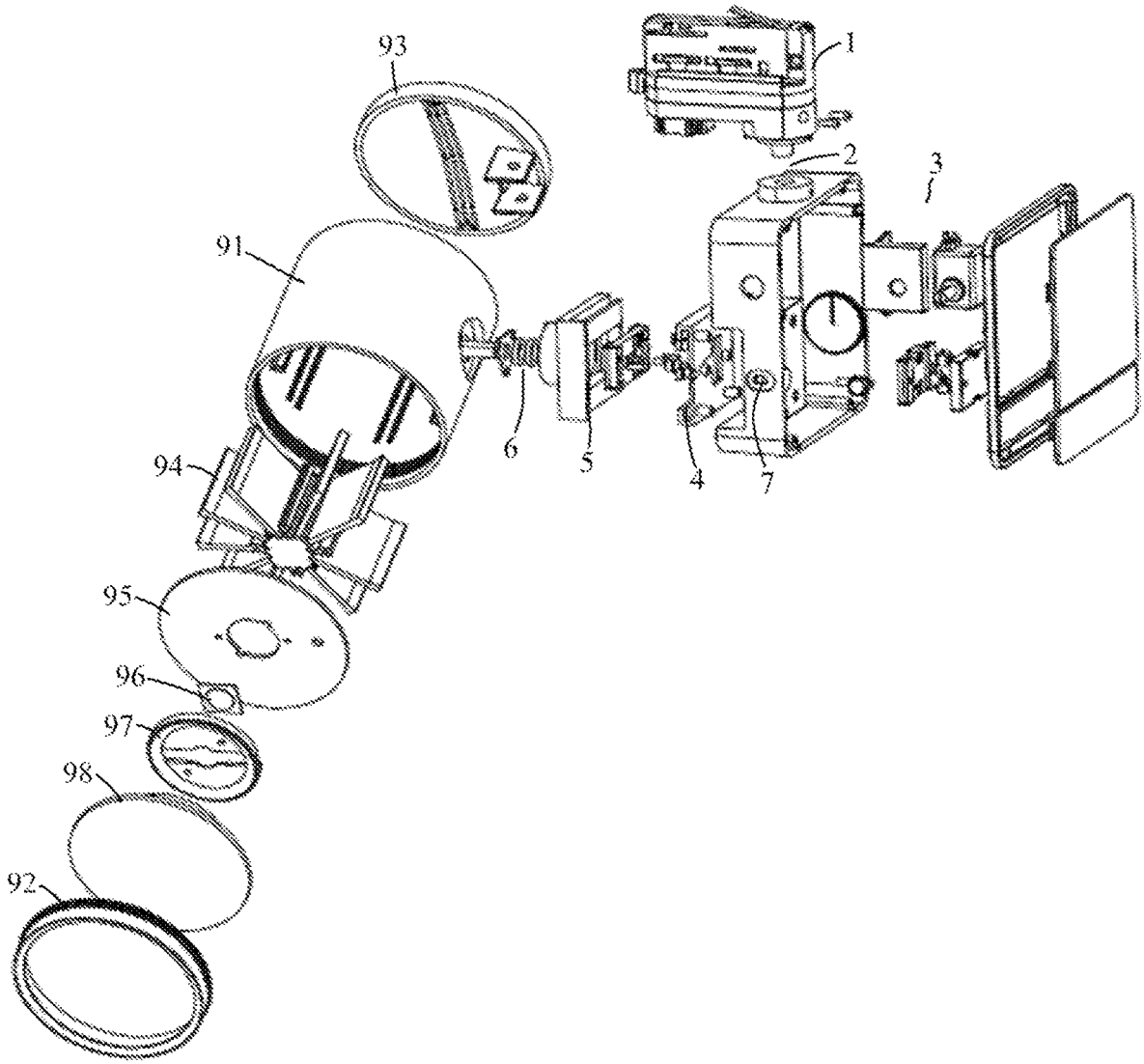
FIG. 7 is an exploded view of a second embodiment of an exemplary modular track light.
Figure 8:
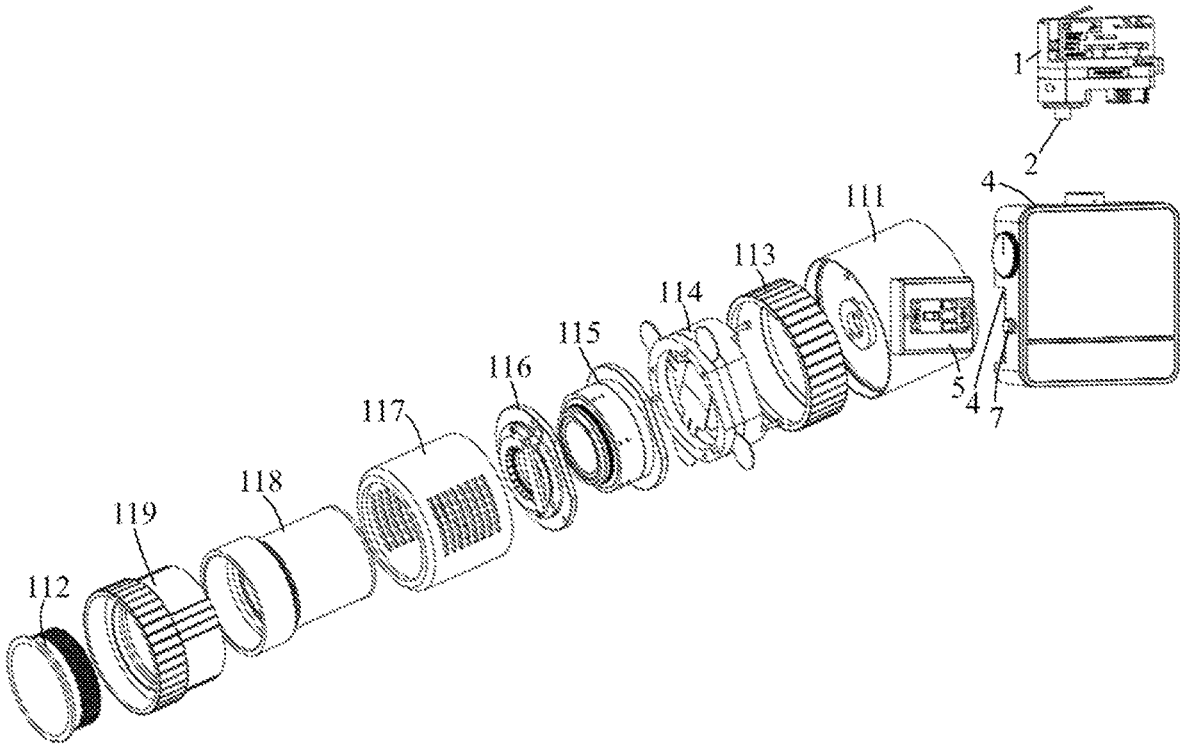
FIG. 8 an exploded view of a third embodiment of an exemplary modular track light.
Figure 9:
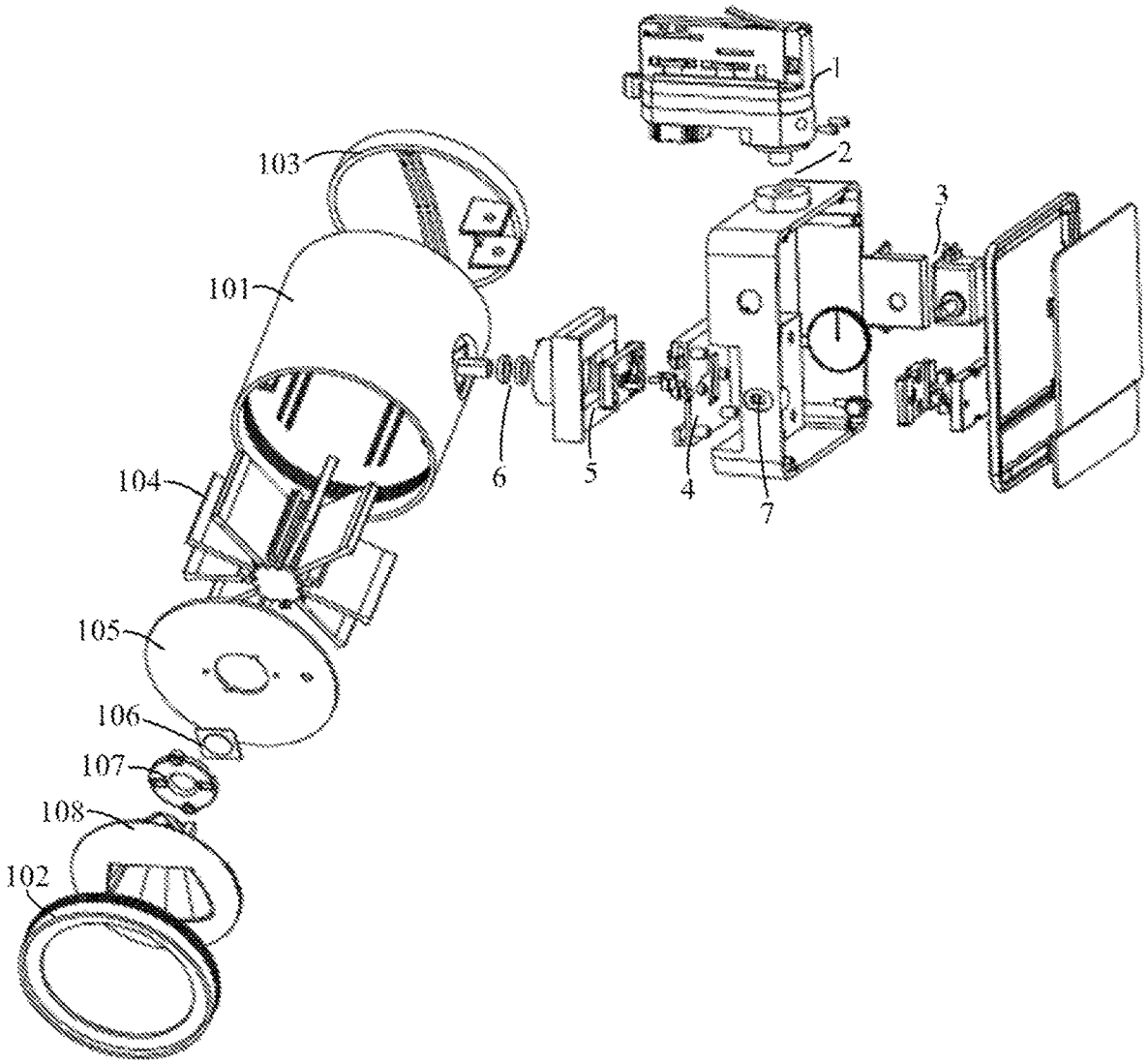
FIG. 9 an exploded view of a fourth embodiment of an exemplary modular track light.

Referring to FIGS. 1-6, this embodiment is a modular, easy to install and remove, track light with an adjustable beam angle degree fixture that is adjustable from 10° to 45°. The adjustable beam angle degree structure is a three-part optical structure. There are two tiered super slim aspheric surface optical lens inside the fixture; these structures can reduce the optical return loss and have the perfect aggregated lighting effect. The modular track light includes an adaptor (1). The adaptor (1) in the illustrations of FIGS. 1-6 show one kind of adaptor, and other kinds of adaptor also can be used for the modular track light; therefore, the adaptor (1) is not limited to those shown in FIGS. 1-6. The adaptor (1) links the electrical box (3) through one or more rotating components (2). Referring to FIGS. 1 and 2, the rotating components (2) include an axle (21) that connects the adaptor (1) and can rotate. The axle (21) extends into the axle hole (22) which is on the electrical box (3). The axle (21) fastens to the electrical box (3) by one or more small bars which extend through one or more holes at the side wall of the axle (21) and the axle hole (22). When the axle (21) rotates, it will cause the electrical box (3) to rotate. The electrical box (3) connects to power by one or more wires which extends inside and through the adaptor (1) and the rotating components (2). There is a groove (31) on the electrical box (3). The power supply plate (4) is at the groove (31). The electrode contact point (42) is on the power supply plate (4) and connects with the wire. The power supply plate (4) connects the power consumption plate (5). The power consumption plate (5) connects the adjustable beam angle degree fixture (8) (adjustable from 10° to 45°) by the first rotating components (6). When the first rotating components (6) swing, it causes the fixture (8) to swing. When the rotating components (2) rotate, it causes the electrical box (3) to rotate. The fixture (8) swings and the electrical box (3) rotation allow the modular track light to adjust the provided lighting area. The power consumption plate (5) can slide relative to the power supply plate (4). The power consumption plate (5) can be easily installed or removed by clipping onto or separating from a snap joint (7) which is at the grooves (31). There are the bars (41) on the two sides of the power supply plate (4) which match the grooves (51) on the two sides of the power consumption plate (5). These structures allow the power consumption plate (5) to slide relative to the power supply plate (4). There is a snap joint installation hole (32) on the grooves (31). When the snap joint (7) vertical moves into the installation hole (32), the power consumption plate (5) is fastened with the power supply plate (4). When the snap joint (7) vertical moves out the installation hole (32), the power consumption plate (5) is separated with the power supply plate (4). When the power consumption plate (5) is fastened on the power supply plate (4), an electrode clip (52) on the power consumption plate (5) connects with an electrode contact point (42) on the power supply plate (4), which creates an electrical connection between the electrical box (3) and the fixture (8). When the power consumption plate (5) is removed from the power supply plate (4), the electrode clip (52) on the power consumption plate (5) separates from the electrode contact point (42) on the power supply plate (4), which electrically disconnects the electrical box (3) from the fixture (8).

Figure 10:
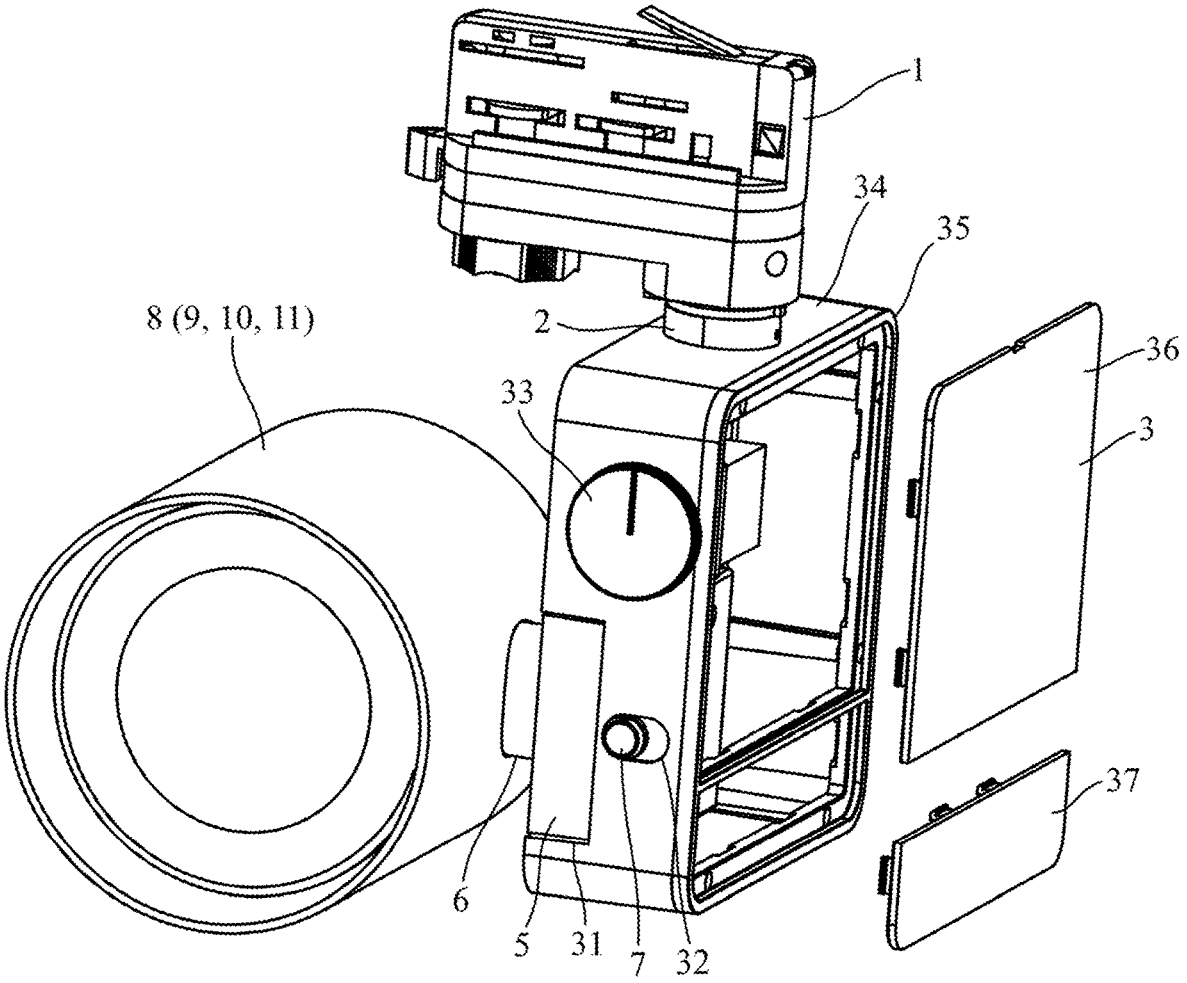
FIG. 10 is a perspective view of an exemplary modular track light.

Referring to FIGS. 1-6, the first rotating components (6) include an axle (61). The axle (61) is fastened on the power consumption plate (5) by a nut (62). The other side of the axle (61) connects the adjustable beam angle degree fixture (8) (adjustable from 10° to 45°) by the locking plate (63). The axle (61) extends into the center hole of a pillar (54) on the power consumption plate (5). When the axle (61) rotates relative to the pillar (54), the fixture (8) swings relative to the pillar (54) and the power consumption plate (5). There is a dimmer (33) at the electrical box (3). The dimmer (33) may connect the power supply plate (4) to power, such as via the wire. The electrical box (3) may be a box (34) having a frame (35) for receiving a first panel (36) and a second panel (37), wherein the first panel (36) and the second panel (37) match openings in the frame (35) to enclose the electrical box (3). The first panel (36) and the second panel (37) may have different textures, patterns, or both thereon. Referring to FIG. 10, the first panel (36) and the second panel (37) are replaceable to provide or match different appearances. There are one or more lenses inside the body (81). A front cover (82) is on the front of the body (81), and a rear cover (83) is on the rear of the body (81). A heat sink (84), LED basement (85), LED (86), LED bracket (87), lens basement (88), adjustment focal lens (89), first lens fixed ring (810), fixed focal lens (811), second lens fixed ring (812), rotation ring (813), sliding ring (814), and glass cover (815) are installed and sealed inside the body (81).

Second Embodiment

Referring to FIGS. 1-5 and 7, this embodiment is a modular, easy to install and remove, modular track light with a fixed beam angle degree fixture (e.g., 12°, 24°, or 36° beam angle). The modular track light has three Fresnel optics solutions (12°, 24°, 36°) which allow emitted light to focus on the objects with smooth facula and low light return loss. The modular track light includes an adaptor (1). The adaptor (1) of FIGS. 1-5 merely shows one kind of adaptor, and other kinds of adaptor also can be used with the modular track light. Therefore, the adaptor (1) is not limited to those shown in FIGS. 1-5. The adaptor (1) links the electrical box (3) through one or more rotating components (2). Referring to FIGS. 1 and 2, the rotating components (2) include an axle (21) that connects the adaptor (1) and can rotate. The axle (21) extends into the axle hole (22) which is at the electrical box (3). The axle (21) fastens to the electrical box (3) by one or more small bars which extend through one or more holes at the side wall of the axle (21) and the axle hole (22). When the axle (21) rotates, it will cause the electrical box (3) to rotate. The electrical box (3) connects to power by one or more wires which extends inside and through the adaptor (1) and the rotating components (2). There is a groove (31) on the electrical box (3). The power supply plate (4) is at the groove (31). The electrode contact point (42) is on the power supply plate (4) and connects with the wire. The power supply plate (4) connects a power consumption plate (5). The power consumption plate (5) connects a fixture (9) by the first rotating components (6). When the first rotating components (6) swing, it causes the fixture (8) to swing. When the rotating components (2) rotate, it causes the electrical box (3) to rotate. The fixture (9) swings and the electrical box (3) rotation allow the modular track light to adjust its lighting area. The power consumption plate (5) can slide relative to the power supply plate (4). The power consumption plate (5) can be easily installed or removed by clipping onto or separating from a snap joint (7) which is at the grooves (31). There are one or more bars (41) at the two sides of the power supply plate (4) which match one or more grooves (51) on the two sides of the power consumption plate (5). These structures allow the power consumption plate (5) to slide relative to the power supply plate (4). There is a snap joint installation hole (32) at the grooves (31). When the snap joint (7) vertical moves into the installation hole (32), the power consumption plate (5) is fastened to the power supply plate (4). When the snap joint (7) vertical moves out the installation hole (32), the power consumption plate (5) is separated from the power supply plate (4). When the power consumption plate (5) is fastened on the power supply plate (4), the electrode clip (52) on the power consumption plate (5) connects with electrode contact point (42) on the power supply plate (4), which creates an electrical connection between the electrical box (3) and the fixture (9). When the power consumption plate (5) is removed from the power supply plate (4), the electrode clip (52) on the power consumption plate (5) separates from the electrode contact point (42) on the power supply plate (4), which electrically disconnects the electrical box (3) from the fixture (9).

Referring to FIGS. 1-5 and 7, the first rotating components (6) include an axle (61). The axle (61) is fastened on the power consumption plate (5) by a nut (62). The other side of the axle (61) connects the fixture (9) by a locking plate (63). The axle (61) extends into the center hole of a pillar (54) on the power consumption plate (5). When the axle (61) rotates relative to the pillar (54), it lets the fixture (9) swing relative to the pillar (54) and the power consumption plate (5). There is a dimmer (33) at the electrical box (3). The dimmer (33) may connect the power supply plate (4) to power, such as via the wire. The electrical box (3) may be a box (34) having a frame (35) for receiving a first panel (36) and a second panel (37), wherein the first panel (36) and the second panel (37) match openings in the frame (35) to enclose the electrical box (3). The first panel (36) and the second panel (37) may have different textures, patterns, or both thereon. Referring to FIG. 10, the first panel (36) and the second panel (37) are replaceable to provide or match different appearances. There are one or more lenses inside the body (91). A front cover (92) is on the front of the body (91), and a rear cover (93) is on the rear of the body (91). A heat sink (94), LED basement (95), LED (96), LED bracket (97), and fixed focal lens (98) are installed and sealed inside the body (91).

Third Embodiment

Referring to FIGS. 1-5 and 8, this embodiment is a modular, easy to install and remove, modular track light with a polarized lighting wall washer fixture. The beam angle degree of this track light is 28°×75°. The curved transition reflective design allows the modular track light to have a smooth rectangle facula, lower light return loss, and better anti-glare function. The modular track light includes an adaptor (1). The adaptor (1) of FIGS. 1-5 merely shows one kind of adaptor, and other kinds of adaptor also can be used with the modular track light. Therefore, the adaptor (1) is not limited to those shown in FIGS. 1-5 and 8. The adaptor (1) links the electrical box (3) through one or more rotating components (2). Referring to FIGS. 1 and 2, the rotating components (2) include an axle (21) that connects the adaptor (1) and can rotate. The axle (21) extends into the axle hole (22) which is on the electrical box (3). The axle (21) fastens to the electrical box (3) by one or more small bars which extend through holes on the side wall of the axle (21) and the axle hole (22). When the axle (21) rotates, it will cause the electrical box (3) to rotate. The electrical box (3) connects to power by one or more wires which extends inside and through the adaptor (1) and the rotating components (2). There is a groove (31) at the electrical box (3). A power supply plate (4) is at the groove (31). An electrode contact point (42) is on the power supply plate (4) and connects with the wire. The power supply plate (4) connects a power consumption plate (5). The power consumption plate (5) connects fixture (10) by the first rotating components (6). When the first rotating components (6) swing, it causes the fixture (10) to swing. When the rotating components (2) rotate, it causes the electrical box (3) to rotate. The fixture (10) swings and the electrical box (3) rotation allow the modular track light to adjust the lighting area. The power consumption plate (5) can slide relative to the power supply plate (4). The power consumption plate (5) can be easily installed or removed by clipping onto or separating from a snap joint (7) which is at the grooves (31). There are the bars (41) on the two sides of the power supply plate (4) which matches the grooves (51) on the two sides of the power consumption plate (5). These structures allow the power consumption plate (5) to slide relative to the power supply plate (4). There is a snap joint installation hole (32) on the grooves (31). When the snap joint (7) vertical moves into an installation hole (32), the power consumption plate (5) is fastened with the power supply plate (4). When the snap joint (7) vertical moves out the installation hole (32), the power consumption plate (5) is separated from the power supply plate (4). When the power consumption plate (5) is fastened on the power supply plate (4), an electrode clip (52) on the power consumption plate (5) connects with electrode contact point (42) on the power supply plate (4), which creates an electrical connection between the electrical box (3) and the fixture (10). When the power consumption plate (5) is removed from the power supply plate (4), the electrode clip (52) on the power consumption plate (5) separates from the electrode contact point (42) on the power supply plate (4), which electrically disconnects the electrical box (3) from the fixture (10).

Referring to FIGS. 1-5 and 8, the first rotating components (6) include an axle (61). The axle (61) is fastened on the power consumption plate (5) by a nut (62). The other side of the axle (61) connects the fixture (10) by a locking plate (63). The axle (61) extends into the center hole of a pillar (54) which is on the power consumption plate (5). When the axle (61) rotates relative to the pillar (54), the fixture (10) swings relative to the pillar (54) and the power consumption plate (5). There is a dimmer (33) at the electrical box (3). The dimmer (33) may connect the power supply plate (4) to power, such as via the wire. The electrical box (3) may be a box (34) having a frame (35) for receiving a first panel (36) and a second panel (37), wherein the first panel (36) and the second panel (37) match openings in the frame (35) to enclose the electrical box (3). The first panel (36) and the second panel (37) may have different textures, patterns, or both thereon. Referring to FIG. 10, the first panel (36) and the second panel (37) are replaceable to provide or match different appearances. There are one or more lenses inside the body (101). A front cover (102) is on the front of the body (101), and a rear cover (103) is on the rear of the body (101). A heat sink (104), LED basement (105), LED (106), LED bracket (107), and fixed focal lens (108) are installed and sealed inside the body (101).

Fourth Embodiment

Referring to FIGS. 1-5 and 9, this embodiment is a modular, easy to install and remove, modular track light with an inserting plate cutting light lens fixture. The modular track light includes an adaptor (1). The adaptor(1) in FIGS. 1-5 merely shows one kind of adaptor, and other kinds of adaptor also can be used with the modular track light. Therefore, the adaptor (1) is not limited to those shown in FIGS. 1-5 and 8. The adaptor (1) links the electrical box (3) through one or more rotating components (2). Referring to FIGS. 1 and 2, the rotating components (2) include an axle (21) that connects the adaptor (1) and can rotate. The axle (21) extends into the axle hole (22) which is on the electrical box (3). The axle (21) fastens to the electrical box (3) by one or more small bars which extend through one or more holes at the side wall of the axle (21) and the axle hole (22). When the axle (21) rotates, it will cause the electrical box (3) to rotate. The electrical box (3) connects to power by one or more wires which extends inside and through the adaptor (1) and the rotating components (2). There is a groove (31) on the electrical box (3). A power supply plate (4) is at the groove (31). An electrode contact point (42) is on the power supply plate (4) and connects with the wire. The power supply plate (4) connects the power consumption plate (5). The power consumption plate (5) connects fixture (11) by the first rotating components (6). When the first rotating components (6) swing, it causes the fixture (11) to swing. When the rotating components (2) rotate, it causes the electrical box (3) to rotate. The fixture (11) swings and the electrical box (3) rotation allow the modular track light to adjust the lighting area. The power consumption plate (5) can slide relative to the power supply plate (4). The power consumption plate (5) can be easily installed and removed by clipping onto or separating from a snap joint (7) which is at the grooves (31). There are one or more bars (41) on the two sides of the power supply plate (4) which match the grooves (51) on the two sides of the power consumption plate (5). These structures allow the power consumption plate (5) to slide relative to the power supply plate (4). There is a snap joint installation hole (32) at the grooves (31). When the snap joint (7) vertical moves into the installation hole (32), the power consumption plate (5) is fastened with the power supply plate (4). When the snap joint (7) vertical moves out the installation hole (32), the power consumption plate (5) is separated with the power supply plate (4). When the power consumption plate (5) is fastened on the power supply plate (4), the electrode clip (52) on the power consumption plate (5) connects with electrode contact point (42) on the power supply plate (4), which creates an electrical connection between the electrical box (3) and the fixture (11). When the power consumption plate (5) is removed from the power supply plate (4), the electrode clip (52) on the power consumption plate (5) separates the electrode contact point (42) on the power supply plate (4), which electrically disconnects the electrical box (3) from the fixture (11).

Referring to FIGS. 1-5 and 9, the first rotating components (6) include an axle (61). The axle (61) is fastened on the power consumption plate (5) by a nut (62). The other side of the axle (61) connects the fixture (11) by a locking plate (63). The axle (61) extends into the center hole of a pillar (54) which is on the power consumption plate (5). When the axle (61) rotates relative to the pillar (54), the fixture (11) swings relative to the pillar (54) and the power consumption plate (5). There is a dimmer (33) at the electrical box (3). The dimmer (33) may connect the power supply plate (4) to power, such as via the wire. The electrical box (3) may be a box (34) having a frame (35) for receiving a first panel (36) and a second panel (37), wherein the first panel (36) and the second panel (37) match openings in the frame (35) to enclose the electrical box (3). The first panel (36) and the second panel (37) may have different textures, patterns, or both thereon. Referring to FIG. 10, the first panel (36) and the second panel (37) are replaceable to provide or match different appearances. There are one or more lenses inside the body (111). A front cover is at the front of the body (111). A first connecting ring (113), second connecting ring (114), basement (115), inserting part (116), ring (117), connecting sleeve (118), adjustment ring (119) are installed and sealed inside the body (111).

The invention is not limited to the above content. Any change, alteration, or revision according to this disclosure are part of the invention. While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A modular track light for a track, the modular track light comprising:

a fixture;

one or more first rotating components;

an electrical box comprising:

a groove;

a power supply plate within the groove, the power supply plate connected to the fixture via the one or more first rotating components and comprising an electrode contact point;

a power consumption plate comprising an electrode clip, the power consumption plate being slidably removeable from the power supply plate, wherein the electrode contact point and the electrode clip form an electrical connection that electrically connects the fixture to the electrical box when the power consumption plate and the power supply plate are fastened together, and the electrode contact point and the electrode clip are electrically disconnected when the power consumption plate and the power supply plate are separated from one another; and a snap joint at the groove that secures the power consumption plate when the power consumption plate and the power supply plate are fastened together;

one or more second rotating components;

an adaptor for attaching the modular track light to the track, the adaptor connected to the electrical box via the one or more second rotating components; and one or more wires that extend through the adaptor and the one or more rotating components to connect the electrical box to a power source.

2. The modular track light of claim 1, wherein the one or more second rotating components comprise an axle that engages the adaptor and extends into the electrical box, wherein the electrical box rotates along with the axle.

3. The modular track light of claim 1, wherein the one or more first rotating components comprise an axle attached at a first side to the power consumption plate via a nut and at a second side to the fixture via a lock plate, the axle extending into a pillar of the power consumption plate, wherein the fixture swings along with the axle.

4. The modular track light of claim 1, wherein the electrical box comprises a dimmer connected to the power supply plate and the one or more wires.

5. The modular track light of claim 4, further comprising a frame at one side of the electrical box and a first panel and a second panel that match openings in the frame are installed on the frame to enclose the electrical box.

6. The modular track light of claim 1, further comprising one or more bars are at two sides of the power supply plate and one or more grooves at two sides of the power consumption plate, wherein the power consumption plate is slidably removable from the power supply plate via the one or more bars and the one or more grooves.

7. The modular track light of claim 6, further comprising a snap joint installation hole at the one or more grooves, wherein the power consumption plate and the power supply plate are fastened together when the snap joint moves into the snap joint installation hole and the power consumption plate and the power supply plate are separated from one another when the snap joint moves out the snap joint installation hole.

8. The modular track light of claim 7, wherein the fixture has an adjustable beam angle degree from 10° to 45°.

9. The modular track light of claim 7, wherein the fixture has a certain beam angle degree of 12°, 24°, or 36°.

10. The modular track light of claim 7, wherein the fixture is a polarized lighting wall washer fixture.

* * * * *